United States Patent [19]

French

[11] 4,036,099

[45] July 19, 1977

[54] METHOD OF LOADING BLAST HOLE WITH EXPLOSIVE

[75] Inventor: Gordon B. French, Rifle, Colo.

[73] Assignee: Occidental Oil Shale, Inc., Grand Junction, Colo.

[21] Appl. No.: 599,096

[22] Filed: July 25, 1975

[51] Int. Cl.[2] ..... F42D 1/08

[52] U.S. Cl. ..... 86/20 C; 102/23

[58] Field of Search ..... 86/20 C, 20 R; 102/23; 299/13

[56] References Cited

U.S. PATENT DOCUMENTS

| | | | |
|---|---|---|---|
| 1,841,874 | 1/1932 | Borchgrevink | 102/23 |
| 2,975,046 | 3/1961 | Cooley et al. | 102/23 |
| 3,170,366 | 2/1965 | Alfredsson | 86/20 C |
| 3,791,255 | 2/1974 | Fox et al. | 86/20 C |
| 3,921,497 | 11/1975 | Christmann et al. | 86/20 C |
| 3,943,820 | 3/1976 | Persson | 86/20 C |

FOREIGN PATENT DOCUMENTS

| | | | |
|---|---|---|---|
| 704,354 | 2/1965 | Canada | 86/20 C |
| 73,645 | 6/1948 | Norway | 86/20 C |

*Primary Examiner*—David H. Brown

*Attorney, Agent, or Firm*—Christie, Parker & Hale

[57] ABSTRACT

A technique is provided for loading an ammonium nitrate-fuel oil (ANFO) explosive mixture upwardly into a vertical blast hole extending as much as 70 feet or more from the open end at the face of the rock structure into which the blast hole is drilled. In order to achieve adequate packing in the hole the ANFO is maintained "soft" by keeping the ammonium nitrate particles substantially free of anti-caking materials. First the hole surface is moistened with water. If the surface dries before the hole is completely loaded, the remaining unloaded length is again moistened. The particles of explosive are blown into the hole through a hose as a mixture with air at a velocity sufficient to bring about packing and sticking of the ANFO in the blast hole. The packing is sufficient to keep the ANFO from falling out of an upwardly extending blast hole. The top end of the hose is centered in the blast hole near the top end of the hole and the stream of air and soft ANFO impacts on the closed end of the hole and packs the explosive to a density of about 0.8 gm/cc. The hose is gradually retracted from the hole as it is filled. Preferably the hose is maintained reasonably straight at all times so that it can be pushed up a long blast hole without kinking. A special centralizer is used at the end of the hose in the hole to help break up ANFO particles.

22 Claims, 2 Drawing Figures

METHOD OF LOADING BLAST HOLE WITH EXPLOSIVE

BACKGROUND

Figure 1:
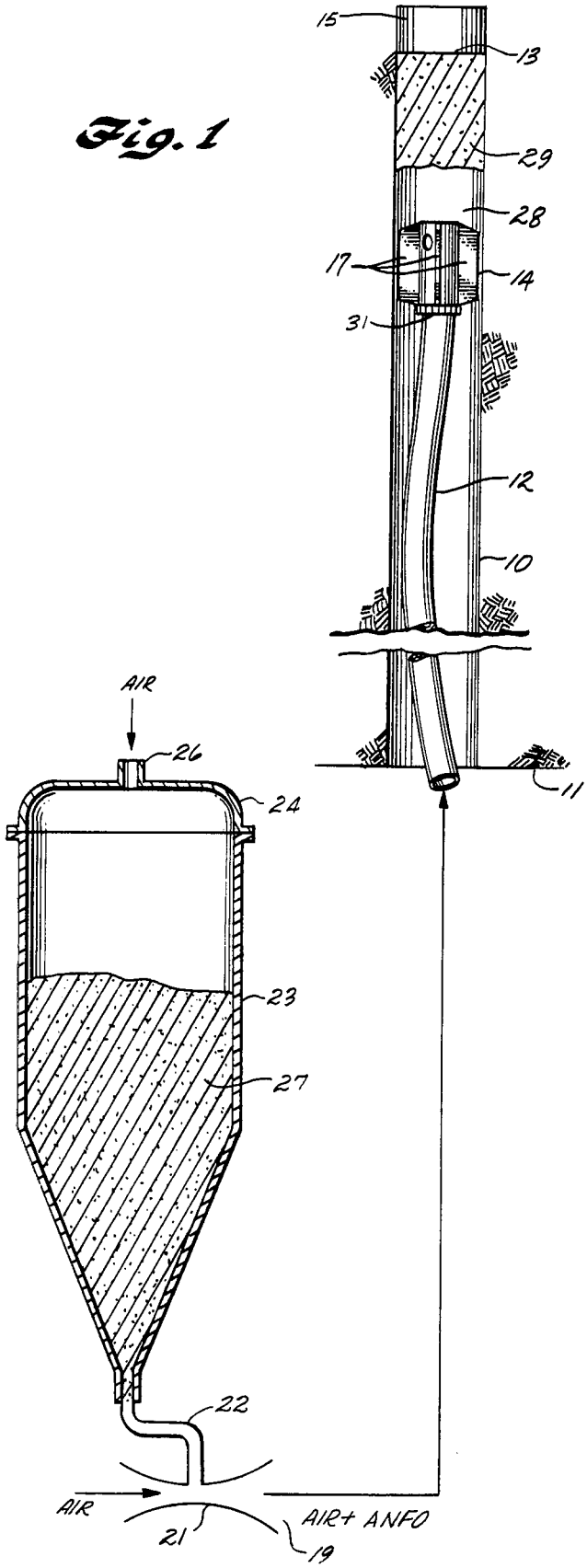

In some mining operations it becomes desirable to have blast holes for explosives extending upwardly from a working chamber. Such upwardly extending blast holes may, for example, be useful in forming raises, blasting to adjacent raises, or for block caving. Suitable blast holes are prepared by drilling upwardly with conventional rock drills to leave a cylindrical blast hole, defined by cylindrical walls of the rock structure that was drilled, within which explosives are placed for subsequent detonation. A number of loading techniques for upwardly extending holes have been developed but none are completely satisfactory for very large scale operations because of costs of the explosives or the effort required for loading. This becomes particularly true as the vertical length of the blast hole is extended.

Prior techniques for loading upwardly extending holes have, for example, included the placement of plugs at intervals in the hole and the pumping of explosive slurries into the hole segments. Such an arrangement can require a plurality of explosive detonators arrayed in the several segments to assure that all portions of the explosive detonate. This may be required because of difficulty in propagating an explosion across the plugs between adjacent segments. The plurality of lead wires coming down the hole creates a particular problem. Dynamite sticks and other prepackaged explosives can be packed into upwardly extending holes but the labor and explosive costs can be high.

A particularly inexpensive explosive for large scale mining operations comprises a mixture of ammonium nitrate and fuel oil commonly known as ANFO. Typically this mixture comprises ammonium nitrate prills mixed with about 5 to 6% of viscous fuel oil that coats the prill surfaces and to some extent works into the prills. Aluminum powder may be included in the mixture for enhanced density and higher energy. Sometimes the ANFO is slightly moistened to enhance sensitivity. Commercial variations of ANFO are available where "dry" reducing materials are mixed with ammonium nitrate. These can also be adapted for use in practice of the invention described herein. Such explosive material is convenient to handle since it is pourable or can be pumped with compressed air. It is extensively used for downhole loading or for lateral holes where it may be blown in with compressed air.

Loading of ANFO into an upwardly extending blast hole has previously been accomplished by blowing a suspension of ANFO in air up through a hose inserted in a blast hole at low velocity, sufficient to convey it through the hose. Some of the ANFO particles would stick at the closed end of the hole and eventually the blast hole would be filled. So far as is known no one has succeeded by such a technique in loading an upwardly extending hole having a length of more than about 30 feet.

Two types of compressed air loading systems have been used in the past. One of these uses a pressurized vessel or "prill pot" wherein the ANFO is partially fluidized and blown through a hose into the blast hole. The other system uses a flow of air through a venturi aspirator to suck up the ANFO from an open vessel and blow it into the hole. Both of these systems are primarily used for loading laterally extending blast holes.

Downwardly extending holes are usually loaded by pouring, although compressed air loading may also be used. The compressed air loading systems can load short upwardly extending blast holes, but are not satisfactory for very long holes extending upwardly from the rock face in which they are drilled.

Recent developments in underground mining and/or retorting of oil shale have established the desirability of loading explosives into upwardly extending blast holes extending 70 feet or more above their bottom ends at the face of the rock structure into which the blast hole was drilled. It is therefore desirable to provide a technique for loading ANFO into such long upwardly extending holes in an economical and reliable manner. Such a loading technique should be consistent with the equipment, personnel, and facilities customarily present in mining operations.

BRIEF SUMMARY OF THE INVENTION

There is, therefore, provided in practice of this invention according to a presently preferred embodiment a method of loading explosive into a blast hole, such as, for example, an upwardly extending blast hole, by inserting a conduit into the blast hole and maintaining its end approximately centered in the blast hole and in the proximity of the end of the hole which is not yet filled with explosive. A large volume of compressed air is mixed with a soft ANFO comprising an explosive mixture of ammonium nitrate and fuel oil particles substantially free of anti-caking materials. This mixture of air and soft ANFO is ejected from the top end of the conduit at a velocity sufficient to pack the ANFO into the blast hole. In a preferred embodiment, the velocity of the ejected air-ANFO mixture is in excess of about 250 feet per second and the end of the conduit from which air-ANFO is ejected, is within about 4 to 24 inches of the end of the unfilled portion of the hole into which the explosive is being packed. In a particularly preferred embodiment the air velocity is nearly as high as the velocity of sound in air (about 1100 feet per second). Preferably the walls of the hole are moistened to enhance adhesion of the ANFO to the wall.

DRAWINGS

Figure 2:
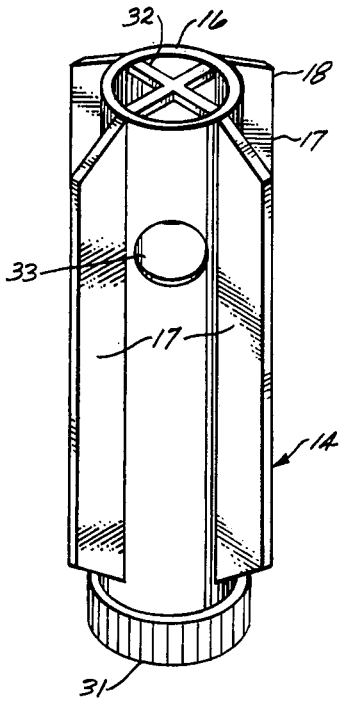

These and other features and advantages of the present invention will be appreciated as the same becomes better understood by reference to the following detailed description of a presently preferred embodiment when considered in connection with the accompanying drawings wherein:

FIG. 1 illustrates semi-schematically an arrangement for loading ANFO into a hole; and FIG. 2 is a perspective view of a special hose tip used in the arrangement of FIG. 1.

DESCRIPTION

FIG. 1 is a semi-schematic illustration of a preferred arrangement for loading explosive up a long upwardly extending blast hole 10. Such a hole is drilled in the roof 11 or other rock face of a mining tunnel or chamber by conventional rock drilling equipment. In a typical embodiment the blast hole 10 may have a diameter of from about 3 to 6 or more inches and extend vertically up to 70 feet, 100 feet or more above the ceiling. Larger and longer blast holes may be used in large scale operations. In long blast holes, a conventional electric cap and detonating charge 15 is placed in the closed end of the hole, by means well known to those skilled in the art, with lead wires (not shown) extending out beyond the hole opening at the rock face. When very long holes are loaded a similar detonator is preferably used every 70 feet or so.

To load explosive into the blast hole, a hose 12 is inserted into the hole to its closed end 13 where the detonating charge is located. The hose can be a conventional, rather stiff but nevertheless flexible, anti-static conductor hose made of plastic or other suitable material. A hose made of antistatic material is used in order to avoid dangerous discharges of static electricity. The hose is sufficiently rigid that, with the lateral support provided by the walls of the blast hole, there is no buckling as the hose is pushed into the hole. In a typical embodiment the anti-static hose has an inside diameter of ¾ inch to one inch and a wall thickness of about ⅛ inch. Larger hoses may be used for larger blast holes.

Since the end of the hose or conduit is subjected to fraying due to the high velocity at which the air-dispersed ANFO is ejected, the hose has an end centralizer 14 comprising centralizing spider means made of brass or other resistant material. Such material can be trimmed intermittantly to remove rough or worn edges. The centralizing spider means 14, further illustrated in perspective in FIG. 2, is mounted at the top end 28 of the hose in FIG. 1. The centralizer has a rigid sleeve 16, the inside diameter of which closely corresponds to the outside diameter of the hose so that when the sleeve is fittted on the end of the hose it fits snugly. A conventional hose clamp 31 connected to the sleeve secures it securely to the hose. This clamp can be deleted since the sleeve will stay in place on the hose of frictional engagement. A plurality of narrow radially extending fins 17 are positioned longitudinally along the sleeve. Each fin has a tapered end 18 at each axial end of the centralizing means in order to minimize the possibility of sticking in the hole. Drilled blasting holes are ordinarily relatively smooth and free of significant ledges so that sticking is rarely a problem. The outside edges of the fins collectively define a cylinder only slightly smaller than the diameter of the blast hole. Thus, the centralizer holds the top end of the hose in the center of the blast hole. It is unimportant whether the lower portions of the hose are centered in the subject hole so that only a centralizer at the top end is used.

A cross shaped metal stream splitter 32 is provided in the open end of the brass centralizer. This serves to break up lumps of ANFO which may happen to become entrained in the air. This precaution may not be needed when the ANFO is finely divided and not caked. Good results have been obtained both with and without such a splitter. A pair of holes 33 are provided on opposite sides of the sleeve. If desired four holes can be used and satisfactory results have also been obtained in some circumstances without any holes.

The other end of the hose (one end of which is inserted in the blast hole), is connected to the outlet 19 (connection not shown) of a conventional venturi nozzle 21 indicated schematically in FIG. 1. An inlet means on the constructed portion of the venturi nozzle is connected to one end of a hose 22, the other end of which is connected to the bottom of a pressurized vessel or "prill pot" 23 so as to provide communication between the interior of the vessel and the interior of the venturi throat. The vessel is provided with a flanged removable cover 24 for easy access and addition of materials. A covered port can be used for filling if preferred. An air pressure line 26 permits pressurization of the interior of the vessel. The use of various valves and pressure gauges, not shown in the drawings, will be apparent to one skilled in the art. A pressurizable hopper with a feed tube dipping into it can also be used to feed a venturi aspirator.

The vessel contains a loose, flowable mixture 27 of explosive particles of ammonium nitrate in fuel oil called ANFO and described in greater detail hereinafter. During operation of the system, compressed air passed through the venturi nozzle 21 aspirates the ANFO mixture from the pressure vessel into the air stream. Pressure applied in the vessel 23 augments the flow of ANFO particles into the air stream. The flow of air through the nozzle entrains the particles of the ANFO mixture and carries then through the length of the hose 12.

The mixture of air and ANFO ejected from the end 28 of the hose 12 initially impinges on the closed top end 13 of the blast hole or on the detonating charge 15 which has previously been placed in the end of the blast hole. The high velocity impact of the ANFO particles causes packing thereof so that a body 29 of packed ANFO explosive builds up in the portion of the blast hole adjacent the closed end.

It is found that adhesion of the packed ANFO to the smooth walls of the drilled blasting hole is enhanced by first moistening the walls of the hole with water. Drilling of the blast holes is ordinarily done with a bit having one or two water jets for cooling and carrying away chips. This thoroughly wets the inside of the hole and if the ANFO is loaded a relatively short time after drilling, the walls are not dried out. Even if an appreciable time elapses, the hole may stay moist because of lack of air circulation in the hole. The compressed air used for blowing the ANFO into the hole does not cause much drying of the walls since compressed air is almost always saturated, even on the driest days. The water jets also erode the walls somewhat so there is slight roughness inside the hole which aids adhesion of the ANFO to the walls. Water from a hose pushed up the hole is also adequate for wetting the hole. Many kinds of rock, and particularly oil shale, have some porosity and the surfaces of the hole remain moistened for some time. The water on the wall surface may cause minor solution of ammonium nitrate and enable the ANFO to stick to the walls upon impingement. If the walls dry out before a hole is completely filled with ANFO the operator at the open end of the hole will observe an increased rain of ANFO particles from the hole. Filling is then stopped and the balance of the hole is remoistened before filling is again commenced.

As the body of packed ANFO builds up from the closed end of the blast hole the air hose is gradually withdrawn so that ANFO continues to impinge on the end of the unfilled portion of the hole and a continuous pack of ANFO is deposited in the blast hole. Under one embodiment of operating conditions as pointed out hereinafter, the end 28 of the hose, having an ID of ¾ inch to 1 inch, can be in the range of from about 4 to 24 inches from the closed end of the unfilled portion of the hole when the velocity of the air-ANFO mixture ejected from the end of the hose is from about 250 to about 1100 feet per second. If the end of the hose is closer to the end of the hole than about 4 inches in this case, the ANFO does not pack well, possibly due to excessive air turbulence, and a large amount of ANFO comes out of the bottom of the blast hole with the discharged air. If the end of the hose is more than about two feet from the end of the hole, the ANFO particles apparently do not have sufficient velocity to impinge on the end hard enough to pack firmly in place and again a significant amount of ANFO comes out of the bottom of the hole with the discharged air. An operator quickly learns proper spacing of the hose from the end of the hole by the sound of the ANFO impact.

It is found that adequate packing of the ANFO at the end of an unfilled portion of a long blast hole is attained when the velocity of the air-ANFO mixture is from about 250 to about 1100 feet per second. The velocity preferably approaches the speed of sound in air for tightest packing. With such a velocity and with the end of the hose within about 4 to 24 inches of the end of a blast hole having a diameter of about 4 inches, a density of the packed ANFO of about 0.8 gm/cc is obtained. This is about one-half of the absolute density of the ANFO material. A density of from about 0.8 to about 1.1 is required for satisfactory propagation of the explosion to occur upon detonation. It is difficult to obtain good explosion characteristics when the density is less than 0.8 or greater than about 1.15. A density of packed ANFO of about 0.82 is found to be satisfactory for blast hole explosion purposes.

In effect, the pressurized prill pot connected to an aspirating venturi nozzle combines the two prior compressed air loading systems. The result is a very greatly increased quantity of air relative to the quantity of ANFO as compared with any prior system. The quantity of air used is not precisely known but is very high, approaching the quantity that would be flowing if the air velocity were supersonic. The quantity of air is very much larger than needed merely to fluidize the ANFO and eject it from the hose (about 50 feet per second will convey ANFO). Prior systems have merely used enough air to convey the ANFO.

In one embodiment a ¾ inch inside diameter hose about 100 feet long was used in a blast hole extending more than 70 feet above the rock face through which it was drilled. A 1 inch air line was connected by a Y to the venturi inlet and to the pressurized prill pot. A one inch air line is capable of conveying about 400 CFM at 40 psig. The flow velocity in this arrangement was not sufficient to obtain tight packing in the long upwardly extending hole. When a two inch air feed line was substituted, adequate flow velocity was obtained. This indicates that flow through the ¾ inch hose was nearly supersonic. Despite this high air flow rate, the amount of ANFO loaded in the hole was in the order of only about 8 to 10 pounds per minute. Prior air loading systems load up to about 60 pounds per minute. Thus, by using a pressurized prill pot and an aspirating venturi in combination, a very much higher air velocity is obtained and the ANFO is packed tightly in the hole.

The ANFO employed in practice of this invention is what is termed herein "soft ANFO". ANFO is a mixture of ammonium nitrate and about 5 to 6% fuel oil. The ammonium nitrate is typically in the form of prills or crystals and this particulate mass is mixed with fuel oil so that the prills or other particles are well coated with the fuel oil. In some explosive mixtures aluminum powder, minor amounts of water or other additives are included for increasing the density and energy of the explosive.

Ordinarily, prills of ammonium nitrate are treated with up to about 5% of an anti-caking material. Typically these anti-caking agents are diatomaceous earth, clay, Kieselguhr, or the like. These anti-caking agents harden the surface of the prills so that their tendency to cake during storage is reduced. It is found important in the practice of this invention to employ soft prills or crystals of ammonium nitrate that are substantially free of such anti-caking materials. Such material readily packs to itself and adheres to the moistened walls of the blast hole when blown into an upwardly directed blast hole at the high velocities employed in practice of this invention. Furthermore, anti-caking materials tend to desensitize the ANFO and may inhibit propagation of the explosion.

As used herein the term "soft ANFO" refers to a mixture of fuel oil and ammonium nitrate particles, with or without other additives, wherein the ammonium nitrate particles are substantially free of anti-caking materials.

The high velocity flow of the air and soft ANFO mixture through the hose appears to be sufficiently turbulent that there is appreciable degradation of the ANFO prills before they reach the end of the hose. At least a portion of any hard surfaces on the prills are broken up in the turbulence. It is believed that this degradation of the ANFO particles exposes surfaces capable of tight packing and enhances the ability of the material to stick to the walls of a blast hole. It is particularly advantageous in the case of an upwardly inclined or vertical blast hole.

Most of the air and ANFO streams directly from the end of the hose through the brass tip 14 and impinges on the end of the blast hole to stick in place. Apparently some of the ANFO also passes through the side holes 33 on the tip and impinges on the walls of the hole. This assures sticking of an initial layer of ANFO on the walls which is of importance in upwardly extending holes. The ANFO sticks well to itself and packs tightly in the hole with good wall adhesion due to this initial layer. Excess air streams out of the hole past the fins of the centralizing means. The stream splitter 32 in the tip serves to break some of the prills to expose fresh surfaces that pack well. The brass tip also serves to limit erosion of the end of the hose. If a plastic hose is used without such a hard tip, it rapidly frays to a feather edge and the ANFO does not appear to pack as well in the hole.

Stream splitters or other obstructions in the hose at any point downstream from the venturi nozzle tend to cause accumulation of ANFO and eventual blocking of the air flow path. It is therefore important to avoid impingement surfaces downstream from the venturi in order to avoid plugging of the air path. Sharp elbows and the like should be avoided.

Excess lengths of hose in the area outside the blast hole should be kept in coils of relatively large diameter during the ANFO loading operation to minimize impingement of ANFO on the walls of the hose and possible plugging and also to inhibit any tendency of the hose to kink or to buckle as it is pushed into the blast hole. Ordinarily for a blast hole 75 feet or so in length, a hose about 100 feet long can be used. The hose is laid out on the floor of the chamber below the blast hole in very large loops 8 to 12 or more feet in diameter. The end of the hose with the tip 14 mounted thereon is then inserted in the end of the blast hole in the face of the rock forming the access chamber from which the blast holes are drilled and the relatively stiff hose is pushed into the hole.

Prior to the insertion of the plastic hose into a blast hole, the minimum radius of curvature of the hose should be at least about 4 feet. The hose is then found to have sufficient straightness and rigidity that it can be manually pushed into the blast hole for considerable distances. If the loops of a plastic hose are made smaller than about 4 feet, undue friction between the hose and the walls of the blast hole due to bends in the hose may be encountered and the distance to which a hose can be inserted into a blast hole significantly reduced. By keeping the radius of curvature of a plastic hose when not in use greater than about 4 feet, problems due to sticking of ANFO in the hose are avoided when the hose is later inserted into a blast hole. With larger diameter air hose, larger radii of curvature are desirable.

To fill a blast hole with soft ANFO the air hose is pushed into the blast hole until the end of the hole is reached. The hose is then retracted about a foot so that the end of the hose is spaced away from the end of the hole. Air pressure is then applied through the venturi and to the vessel containing the ANFO particles; in one embodiment, for example, about 40 psi is applied to each. The resultant high velocity flow of air through the hose entrains ANFO and ejects it against the end of the hole. As the pack of ANFO in the top of the hole builds up, the distance between the end of the hose and the face on which the particles are impinging continually decreases. When the surface comes close to the end of the hose the sound of impingement becomes different and can readily be detected by the person at the bottom of the hole. Further appreciable amounts of ANFO begin to be ejected from the bottom of the hole with the discharged air. When a change of sound is noted the hose is lowered about a foot and additional packing of ANFO in the top of the hole proceeds. Thus, as the hole is filled the hose is gradually lowered until the desired length of the blast hole has been filled. As the hose is withdrawn from the hole it is laid on the floor in large loops to prevent kinking. About 20 minutes is sufficient to fill a 3 inch hole extending 75 feet above the mining chamber. After filling the hole a detonator (not shown) is inserted in in the lower end for detonating the ANFO. If desired a string of detonating cord may be left in the blast hole running from end to end (before filling) to assure propagation of the explosion along the full length of the blast hole.

One operation where loading of ANFO in upwardly extending blast holes is of considerable importance is in preparation of in situ retorts for recovering oil from oil shale. In such an embodiment a room or chamber is formed in a lower portion of an oil shale deposit, and the oil shale above the room is explosively expanded or fragmented to form an in situ retort.

In one such arrangement, for example, a square retort about 32 feet on the side and about 82 feet tall is formed in the oil shale. A room about 32 feet square is excavated in the lower portion of the volume to become the oil shale retort. This room serves as a base of operations for preparing the retort for blasting. A large central raise extends upwardly from the room to the top of the volume to become the retort. The volume of the raise corresponds to the void volume desired in the rubble pile of fragmented oil shale in the retort after the shale is fragmented. A plurality of blast holes are drilled upwardly from the ceiling of the room to the top of the volume to become the retort. Preferably these holes are drilled in a series of concentric rings around the raise with an additional row of blast holes along the vertical boundaries of the volume to become the retort.

A technique as hereinabove described is used for loading ANFO into the vertically extending blast holes, which may be 3 or 3½ inch diameter. After all of the blast holes have been loaded and appropriate time delayed detonators provided in each, the entire assemblage is blasted at the same time. This blasting fragments the oil shale in the volume to become the retort and expands it into the room at the bottom and into the central raise thereby substantially filling the retort with a rubble pile of fragmented shale.

A retorting fluid is then passed downwardly through the rubble pile of oil shale particles for decomposing the carbonaceous kerogen and recovering liquid shale oil.

Although limited embodiments of technique for loading soft ANFO into a blast hole have been described and illustrated herein, many modifications and variations will be apparent to one skilled in the art. Thus, for example, the equipment mentioned is exemplary and several variations will be immediately apparent. Thus, for example, the vessel for holding the ANFO may be a pressurized screw fed hopper for providing a steady flow of ANFO into a venturi nozzle. Partly rigid conduits can be used downstream from the venturi so long as sharp changes in direction are avoided to prevent caking and plugging. Although in the preferred arrangements the hose is pushed into the hole manually, various devices for aiding the insertion or the retention of the hose in the blast hole will be apparent. Many other modifications and variations will be apparent to one skilled in the art and it is therefore to be understood that within the scope of the appended claims the invention may be practiced otherwise than as specifically described.

What is claimed is:

1. A method of loading explosive into an upwardly extending blast hole having an open lower end and a closed upper end above said open end, comprising the steps of:

moistening the walls of the blast hole;

inserting a conduit into the blast hole so that the inserted open end of said conduit is positioned near the end of said blast hole not yet filled with explosive;

conveying a mixture of air and ANFO through said conduit, the ANFO comprising an explosive mixture of fuel oil and ammonium nitrate; and ejecting said mixture of air and ANFO from the inserted open end of said conduit at a velocity sufficient to adhere said ANFO to the moistened walls of the blast hole and to pack said ANFO into said blast hole.

2. A method of loading explosive as defined in claim 1 wherein the conduit comprises a flexible anti-static hose and the step of inserting comprises:

maintaining the hose reasonably straight, reasonably straight meaning having a radius of curvature on any bends of no less than about four feet; and pushing the hose up the upwardly extending blast hole from the bottom.

3. A method of loading explosive as defined in claim 1 wherein the mixture is formed by the steps of:

passing at least a portion of the air through a venturi nozzle at high velocity; and applying air pressure to a bed of ANFO particles connected to the aspirating inlet of the venturi nozzle for aiding in aspirating ANFO particles into the venturi nozzle.

4. A method of loading explosive as defined in claim 1 wherein the ejection velocity of the mixture of air and soft ANFO is greater than about 250 feet per second.

5. A method of loading explosive as defined in claim 1 wherein the ejection velocity of the mixture of air and soft ANFO is nearly the speed of sound.

6. A method as defined in claim 1 wherein the inserting step further comprises maintaining the open end of the conduit in the range of from about 4 inches to about 2 feet from the end of the blast hole not yet filled with explosive.

7. A method as defined in claim 1 wherein the ejecting step comprises:

ejecting the principal portion of the mixture longitudinally from the end of the conduit; and ejecting a minor portion of the mixture laterally near the end of the conduit.

8. A method as defined in claim 1 wherein the quantity of air in the mixture is very much larger than needed merely to fluidize the ANFO.

9. A method of loading explosive as defined in claim 1 wherein the ANFO includes ammonium nitrate substantially free of anti-caking materials.

10. A method of loading explosive as defined in claim 1 further comprising keeping the conduit free of impingement surfaces downstream from the point of mixing the air and soft ANFO.

11. A method of loading explosive as defined in claim 10 wherein the step of keeping the conduit free of impingement surfaces comprises coiling the conduit in loops having a radius of curvature no less than about 4 feet.

12. In a method of loading explosive in an upwardly extending blast hole having an open lower end and a closed upper end wherein a conduit is inserted in the open end of the blast hole toward the closed end and a mixture of air and ANFO particles is ejected from the end of the conduit for packing ANFO in the end of the blast hole, the improvement comprising:

moistening the walls of the blast hole; and ejecting the mixture of air and ANFO particles from the end of the conduit at a velocity in excess of about 250 feet per second within about 4 inches to about 2 feet from the end of the unfilled portion of the blast hole.

13. In a method of loading explosive as defined in claim 12 the further improvement comprising mixing fuel oil and ammonium nitrate prills substantially free of anti-caking materials for forming a soft ANFO for ejection from the conduit.

14. In a method as defined in claim 12 the further improvement wherein the mixture of air and ANFO is ejected at nearly supersonic velocity.

15. A method of loading explosive in an upwardly extending blast hole hving an open lower end and a closed top end above the open lower end comprising the steps of:

inserting a conduit upwardly into the open lower end of the blast hole so that an open upper end of the conduit is positioned near the end of the blast hole not yet filled with explosive;

ejecting a mixture of fuel oil and ammonium nitrate from the conduit laterally against moistened walls of the blast hole with sufficient force to adhere the mixture thereto; and ejecting a mixture of fuel oil and ammonium nitrate from the conduit upwardly towards the top end of the blast hole with sufficient force to pack the mixture into the blast hole.

16. A method as defined in claim 15 wherein the ammonium nitrate is in the form of prills substantially free of anti-caking materials.

17. A method of loading explosive into an upwardly extending blast hole having an open lower end and a closed upper end above said open end, comprising the steps of:

moistening the walls of the blast hole;

inserting a conduit into the blast hole to the closed end;

conveying a mixture of air and ANFO through said conduit, the ANFO comprising an explosive mixture of fuel oil and ammonium nitrate; and ejecting the mixture of air and ANFO from the inserted open end of the conduit at a velocity in excess of about 250 feet per second within about 4 inches to about 2 feet from the end of the unfilled portion of the blast hole to adhere the ANFO to the moistened walls of the blast hole and to pack the ANFO in the blast hole.

18. A method of loading explosive as defined in claim 17 the further improvement wherein the mixture of air and ANFO is ejected at nearly supersonic velocity.

19. A method of loading explosive as defined in claim 17 the further improvement comprising ejecting the principal portion of the mixture longitudinally from the end of the conduit; and ejecting a minor portion of the mixture laterally near the end of the conduit.

20. A method of loading explosive as defined in claim 17 the further improvement wherein the ANFO includes ammonium nitrate prills substantially free of anti-caking materials.

21. A method of loading explosive as defined in claim 20 the further improvement comprising impacting at least a portion of the prills on a stream splitter in an end of the conduit prior to ejecting them from the conduit to break surfaces of the prills.

22. In a method of loading explosive in an upwardly extending blast hole having an open lower end and a closed upper end wherein a conduit is inserted in the open end of the blast hole toward the closed end and a mixture of air and ANFO particles is ejected from the end of the conduit for packing ANFO in the end of the unfilled portion of the blast hole, the improvement comprising:

moistening the walls of the blast hole; and ejecting the mixture of air and ANFO particles at least partly against the moistened walls of the blast hole.

* * * * *